US007715939B2

(12) United States Patent
Kuki et al.

(10) Patent No.: US 7,715,939 B2
(45) Date of Patent: May 11, 2010

(54) EMBROIDERY SEWING MACHINE WITH PRINTING FUNCTION

(75) Inventors: Masakazu Kuki, Ichinomiya (JP); Hiroshi Kitazawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 648 days.

(21) Appl. No.: 10/594,751

(22) PCT Filed: Jan. 27, 2005

(86) PCT No.: PCT/JP2005/001109

§ 371 (c)(1),
(2), (4) Date: May 17, 2007

(87) PCT Pub. No.: WO2005/100663

PCT Pub. Date: Oct. 27, 2005

(65) Prior Publication Data

US 2008/0011212 A1 Jan. 17, 2008

(30) Foreign Application Priority Data

Mar. 30, 2004 (JP) ..... 2004-098112

(51) Int. Cl.
*D05C 5/02* (2006.01)

(52) U.S. Cl. ..... 700/138; 112/103; 112/470.06

(58) Field of Classification Search ..... 700/133, 700/136–138; 112/102.5, 103, 119, 470.06, 112/470.09, 470.18
See application file for complete search history.

(56) References Cited

U.S. PATENT DOCUMENTS

| | | | | |
|---|---|---|---|---|
| 5,144,899 | A * | 9/1992 | Allen | 112/103 |
| 6,189,989 | B1 | 2/2001 | Hirabayashi et al. | |
| 6,435,117 | B2 * | 8/2002 | Codos et al. | 112/475.08 |

FOREIGN PATENT DOCUMENTS

| | | |
|---|---|---|
| JP | A 63-283682 | 11/1988 |
| JP | A 05-208085 | 8/1993 |
| JP | A 05-272046 | 10/1993 |
| JP | U 05-95474 | 12/1993 |
| JP | A 06-299458 | 10/1994 |
| JP | A 09-250068 | 9/1997 |
| JP | A 09-256260 | 9/1997 |
| JP | A 09-279469 | 10/1997 |
| JP | A 2002-200379 | 7/2002 |
| JP | A 2004-034667 | 2/2004 |

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

An embroidery sewing machine with a printing function includes a sewing machine body having a bed, a foot, an arm, and capable of sewing a workpiece cloth by a sewing unit; a cloth holding frame holding the workpiece cloth; a frame drive unit moving the cloth holding frame independently in two mutually perpendicular directions in a horizontal plane; an ink-jet printer having a print head printing the workpiece cloth. The print head of the printer includes nozzle arrays with each nozzle array having a plurality of ink-jet nozzles aligned parallel in the first direction, and the printer prints the workpiece cloth while moving the cloth holding frame in the second direction.

4 Claims, 11 Drawing Sheets

EMBROIDERY SEWING MACHINE WITH PRINTING FUNCTION

TECHNICAL FIELD

The present invention relates to an embroidery sewing machine with printing function capable of printing a workpiece cloth by an ink-jet printing unit.

BACKGROUND TECHNOLOGY

A conventional embroidery sewing machine includes a sewing machine body; a cloth holding frame that holds a workpiece cloth in a stretched manner; a frame drive unit that drives the cloth holding frame independently in two mutually perpendicular directions in a horizontal plane. Provided in an arm of the sewing machine body is a needle bar vertically moving mechanism that vertically moves the needle bar. Also, various types of loop takers are provided in a bed of the sewing machine body. Household embroidery sewing machines having the frame drive unit installed in the bed of the sewing machine body have been reduced to practice in the household sewing machine field also.

In recent years, embroidery sewing machines have been suggested that allow both embroidery and print images to be formed on the workpiece cloth. In such embroidery sewing machines, an ink-jet print head is disposed in the proximity of the upper surface of the workpiece cloth which is held by the cloth holding frame linked to the frame drive unit; and the print head prints various patterns and graphics directly on the workpiece cloth by moving the cloth holding frame in the horizontal direction by the frame drive unit.

For example, JP-A-H09-256260 discloses an embroidery sewing machine as described as follows (refer to pages 3 to 4, and FIGS. 2 and 3 in particular). The disclosed embroidery sewing machine is a multi-headed sewing machine incorporating two embroidery sewing machines. A plurality of needle bars and one print head are provided in a color changing mechanism of each embroidery sowing machine. In response to an input of embroidery data upon needle bar selection, the sewing needle is driven and a rectangular embroidery frame is further moved in X-Y direction. Thus, the intended embroidery pattern can be sewn. By selecting a print head, the embroidery frame is moved in X-Y direction based on the inputted print data, thereby allowing the execution of a color printing operation with colors such as cyan, magenta and yellow. More specifically, when executing a printing operation, ink is ejected from the print head in synchronism with the reciprocating movement of the embroidery frame (workpiece cloth) moving in one way at a time in the X-direction; whereupon completion of printing one print line (one way), the embroidery frame is fed by one print line in the Y-direction and the process repeats itself thereafter.

Patent document 1: JP-A-H09-256260

DISCLOSURE OF THE INVENTION

Problem to be Overcome by the Invention

The embroidery sewing machine described in the above JP-A-H09-256260 includes an X-direction drive mechanism that reciprocably drives the embroidery frame in the X-direction (lateral direction) and a Y-direction drive mechanism that reciprocably drives the embroidery frame in the Y-direction (longitudinal direction) respectively. A stepping motor, generally accepted to have simple drive controllability, is employed in the foregoing mechanisms. In the attempt to reciprocably rotate the stepping motor without falling out of step, an acceleration/deceleration state, in which a rotational speed change occurs, needs to be created at the time of altering the drive direction. Thus, the printer employing the above construction provides poor printing quality in the acceleration/deceleration area corresponding to the acceleration/deceleration state. To overcome such problem, the printer needs to be restricted from printing the workpiece cloth in the acceleration/deceleration area of the stepping motor.

However, such restriction in the acceleration/deceleration area of the stepping motor gives rise to a problem of reduced printable area. However, no considerations were given nor ideas were devised to address such problems in the above conventional embroidery sewing machine. Especially in the case of household embroidery sewing machines, there was a limitation in the spacing between the sewing needle and the foot, in other words, the distance in the direction parallel to the lengthwise direction of the bed, which reduces the printable area to a considerable extent.

Therefore, it is an object of the present invention to provide an embroidery sewing machine with printing function capable of securing sufficient printable area.

Means for Overcoming the Problems

The embroidery sewing machine with printing function of the present invention includes a sewing machine body having a bed, a foot, and an arm and capable of sewing a workpiece cloth by a sewing unit; a cloth holding frame that holds a workpiece cloth to be sewn, a frame drive unit that moves the cloth holding device independently in two mutually perpendicular directions in a horizontal plane, and an ink-jet printer having a print head that prints the workpiece cloth held by the cloth holding frame, wherein the frame drive unit has a first drive mechanism that moves the cloth holding frame in a first direction parallel to a lengthwise direction of the bed, and a second drive mechanism that drives the cloth holding frame in a second direction perpendicular to the first direction, and wherein the print head of the printer comprises arrays of nozzles having a plurality of ink-jet nozzles aligned parallel to the first direction and the printer prints the workpiece cloth while moving the cloth holding frame in the second direction by the second drive mechanism.

Also, in the above described construction, it is preferable to employ a stepping motor as a drive source, set the acceleration/deceleration area, where rotational speed change of the stepping motor occurs, to be arranged in both ends in the second direction of the cloth holding frame, and arrange the printer to execute a printing operation in the area exclusive of the acceleration/deceleration area.

Under such construction, though the movable distance of the cloth holding frame in the first direction is limited by the presence of the foot, greater movable distance in the second direction can be obtained as compared with the first direction of the cloth holding frame. As for the shape of the cloth holding frame also, greater length in the second direction can be obtained as compared with the first direction. Since the printer prints the workpiece cloth while moving the print head in the second direction, in other words, the lengthwise direction of the cloth holding frame, larger printable area can be obtained in the second direction as compared with the printing operation executed while moving the print head in the first direction, even if a unprintable acceleration/deceleration area were to be set. Moreover, since the printing direction is taken in the longer direction and the cloth feed direction is taken in the shorter direction, switching times of the stepping motor drive direction can be reduced, in which respect also, the overall acceleration/deceleration area can be reduced, in other words, greater printable area can be obtained.

Effect of the Invention

As described above, sufficient printable area can be secured within the cloth holding frame according to the embroidery sewing machine with printing function of the present invention.

EXPLANATION OF REFERENCE SYMBOLS

Reference symbol 1 designates an embroidery sewing machine with printing function; 2, a sewing machine main body; 3, a cloth holding frame; 4, a frame drive device; 5, a printer; 10, a bed; 11, a foot; 12, an arm; 30, a Y-direction drive mechanism (second drive mechanism); 45, an X-direction drive mechanism (first drive mechanism); 61, a print head; 61*b*, an ink-jet nozzle; 61*c* to 61*f*, nozzle arrays; 63, a purge unit (purge mechanism); 80, a head cap (cap mechanism); 99, a sewing unit; W, a workpiece cloth; and J, a acceleration/deceleration area.

BEST MODE FOR CARRYING OUT THE INVENTION

One embodiment of the present invention will be described in detail with reference to the drawings for the purpose of describing the present invention.

Figure 1:
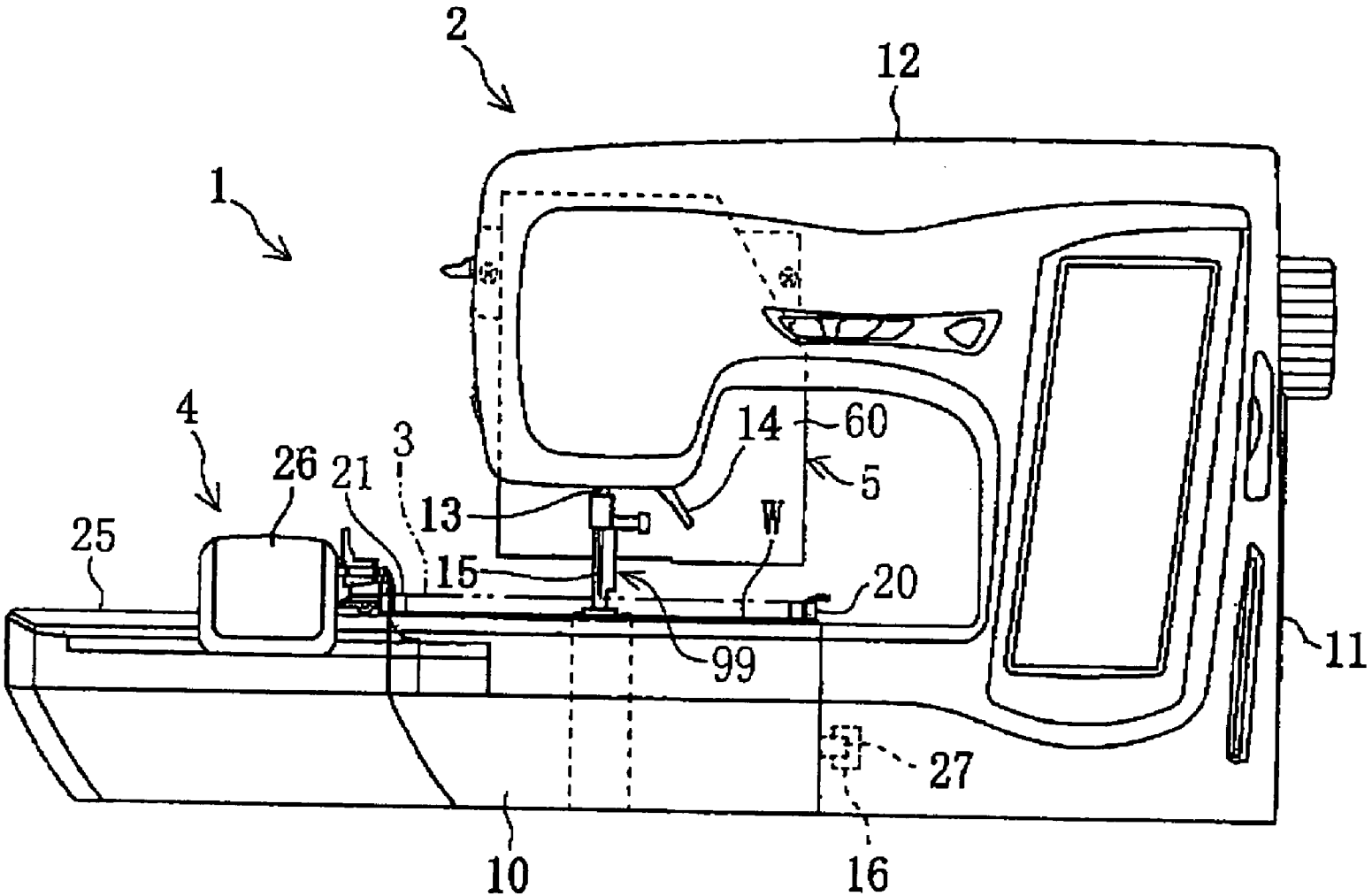
FIG. 1 is a front view of an embroidery sewing machine with printing function in accordance with the present invention.
Figure 2:
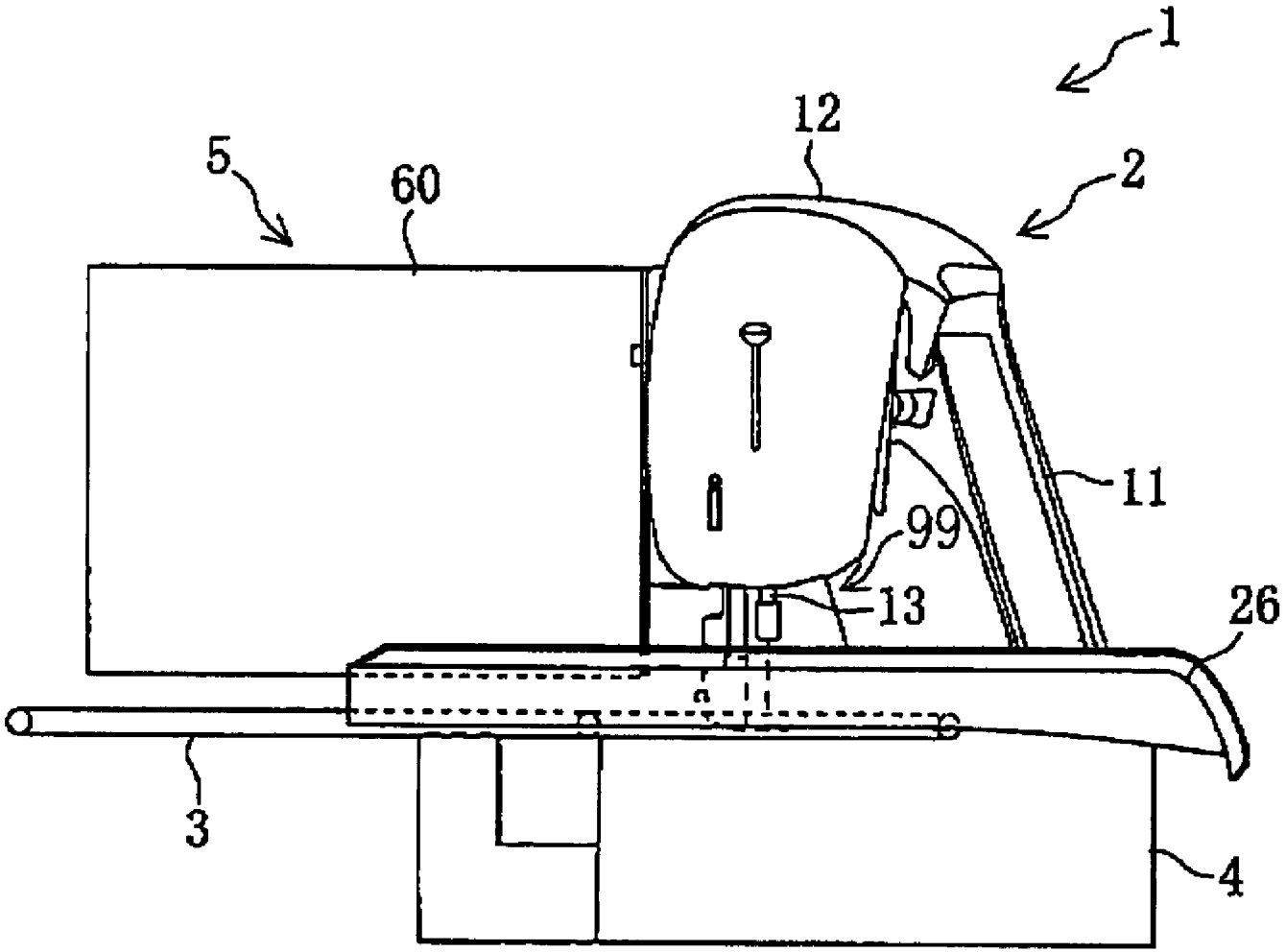
FIG. 2 is a side view of the embroidery sewing machine with printing function in accordance with the present invention.
Figure 3:
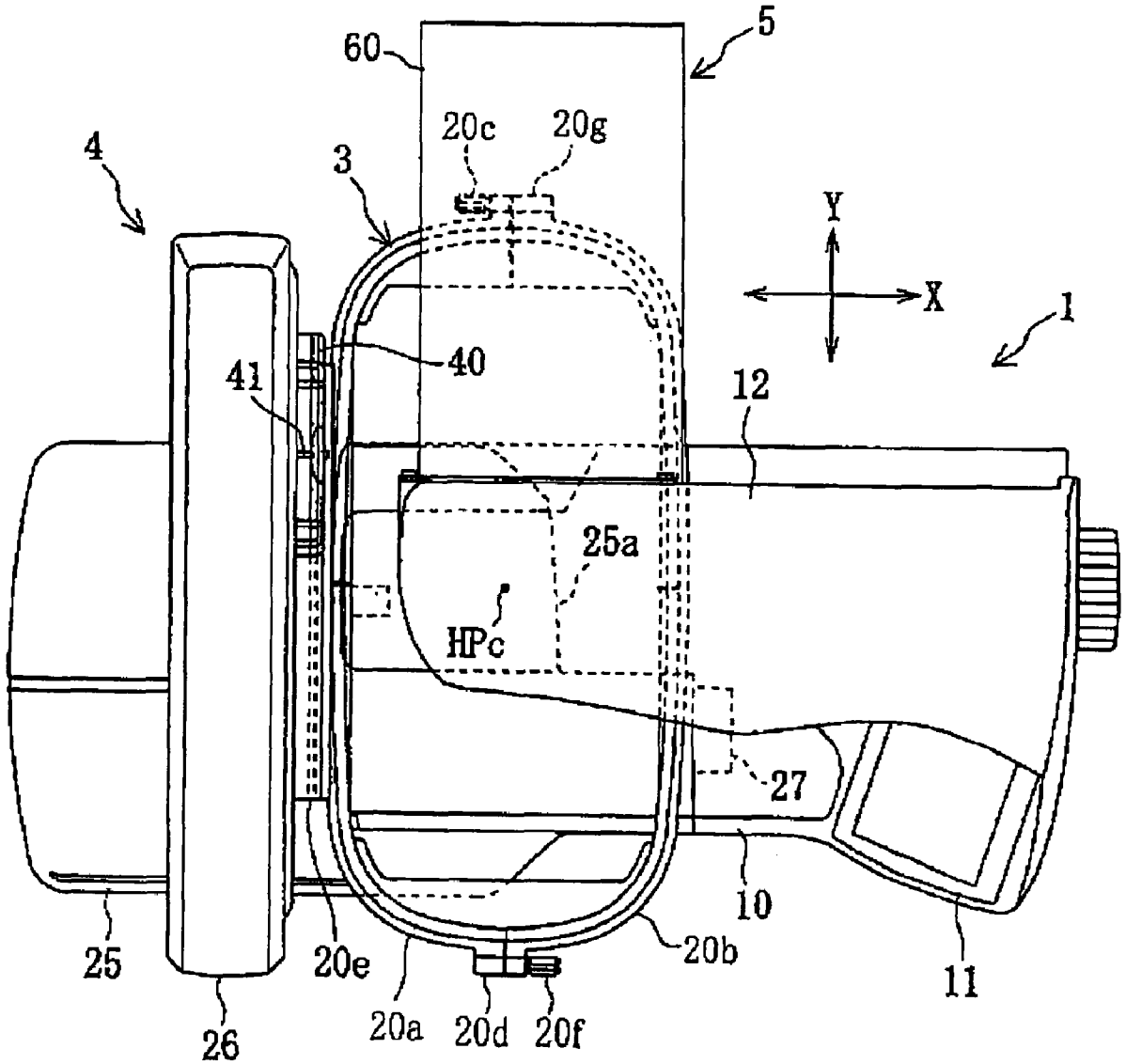
FIG. 3 is a plan view of the embroidery sewing machine with printing function in accordance with the present invention.
Figure 8:
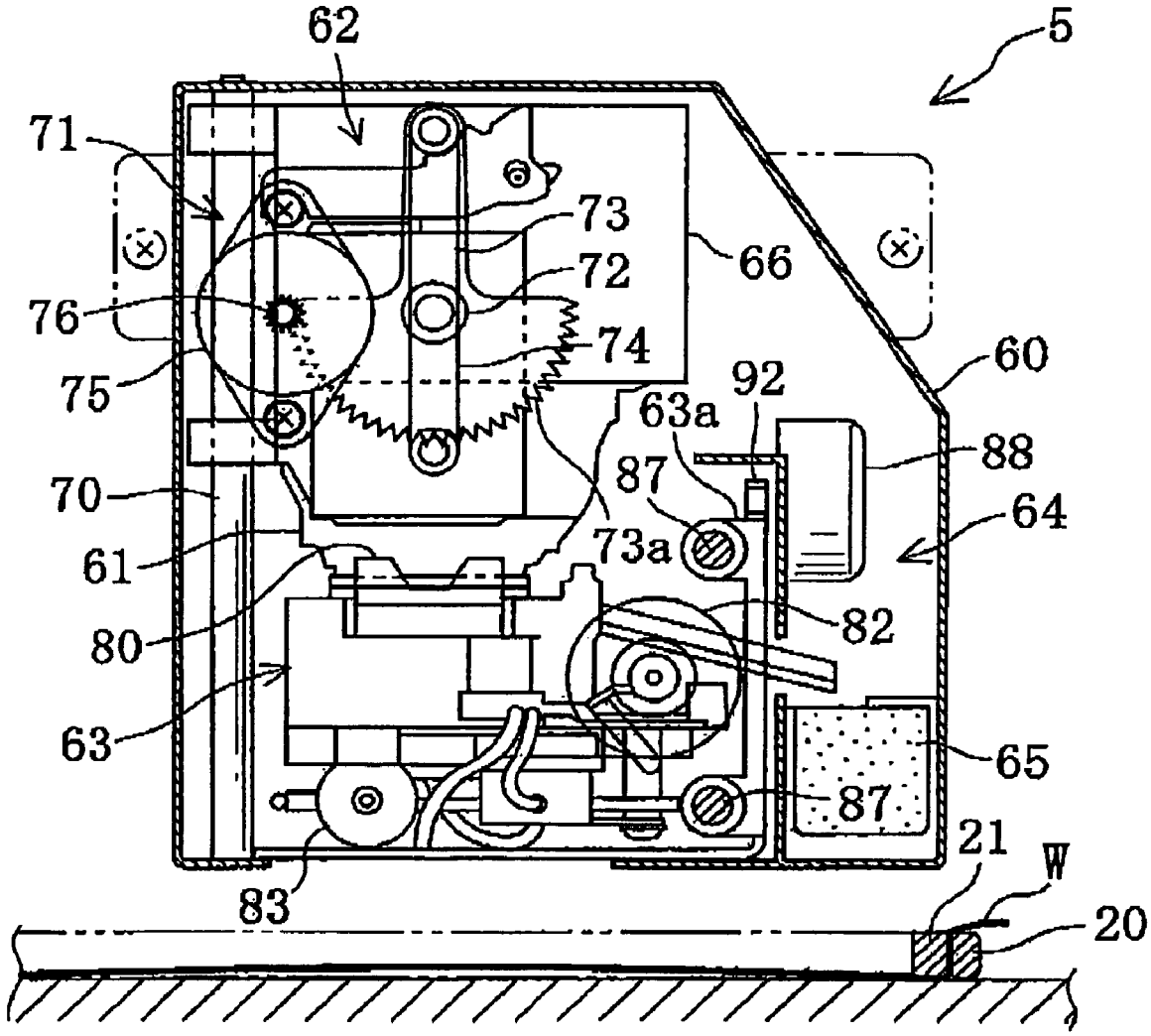
FIG. 8 is a transverse plan view of a main portion of a printer when a print head is in a retracted position.

Referring to FIGS. 1 to 3, an embroidery sewing machine with printing function 1 in accordance with the present embodiment has a sewing machine body 2 capable of sewing a workpiece cloth W (refer to FIG. 8). The sewing machine body 2 has a frame drive unit 4 mounted thereto and the frame drive unit 4 has a detachable rectangular cloth holding frame 3 holding the workpiece cloth attached thereto. As will be described in detail later, the frame drive unit 4, as shown in FIG. 3, is adapted to move the cloth holding frame 3 and consequently the workpiece cloth W independently in an X-direction (lateral direction) which is a first direction parallel to the lengthwise direction of a bed 10 and a Y-direction (longitudinal direction) which is the second direction perpendicular thereto. As will be described later also, the sewing machine body 2 has an ink-jet printer 5 capable of printing the workpiece cloth provided integrally therewith.

Next, a description will be given on the sewing machine body 2. As shown in FIGS. 1 to 3, the sewing machine body 2 includes a bed 10, a foot 11 standing upward from the right end of the bed 10, and an arm 12 extending leftward from the upper end of the foot 11 so as to confront the bed 10.

Provided in the foot 11 and the arm 12 is a drive force transmitting mechanism (not shown) that transmits the drive force of the sewing machine motor 93 (refer to FIG. 11) to a main shaft (not shown). Inside a head (left portion of arm 12 in FIG. 1) of the arm 12 are a needle bar vertically moving mechanism (not shown) that vertically moves the needle bar 13; a thread take-up drive mechanism (not shown) driving the thread take-up (not shown) that pulls up the needle thread; a presser drive mechanism (not shown) that vertically moves a cloth presser (not shown) by an operation of an operation lever 14; and the like. Since the foregoing are generally known technologies, detailed description for the same will not be given.

The bed 10 has a loop taker (not shown) that forms a seam in synchronism with the vertical movement of a sewing needle 15 and a lower shaft, or the like, that transmits the rotational drive force of the sewing machine motor 93 to the loop taker. An attachment portion 25*a* (refer to FIG. 3) of the later described frame drive unit 4 is connected to an attachment subject portion (not shown) formed in the bed 10. In such case, as shown in FIG. 1, the attachment subject portion has a female connector 16 connectable to a male connector 27 provided in the attachment portion 25*a* of the frame drive unit 4. A sewing unit 99 comprises a needle bar 13, a sewing needle 15, a sewing machine motor 93, the needle bar vertically moving mechanism, the loop taker, and the like.

Figure 4:
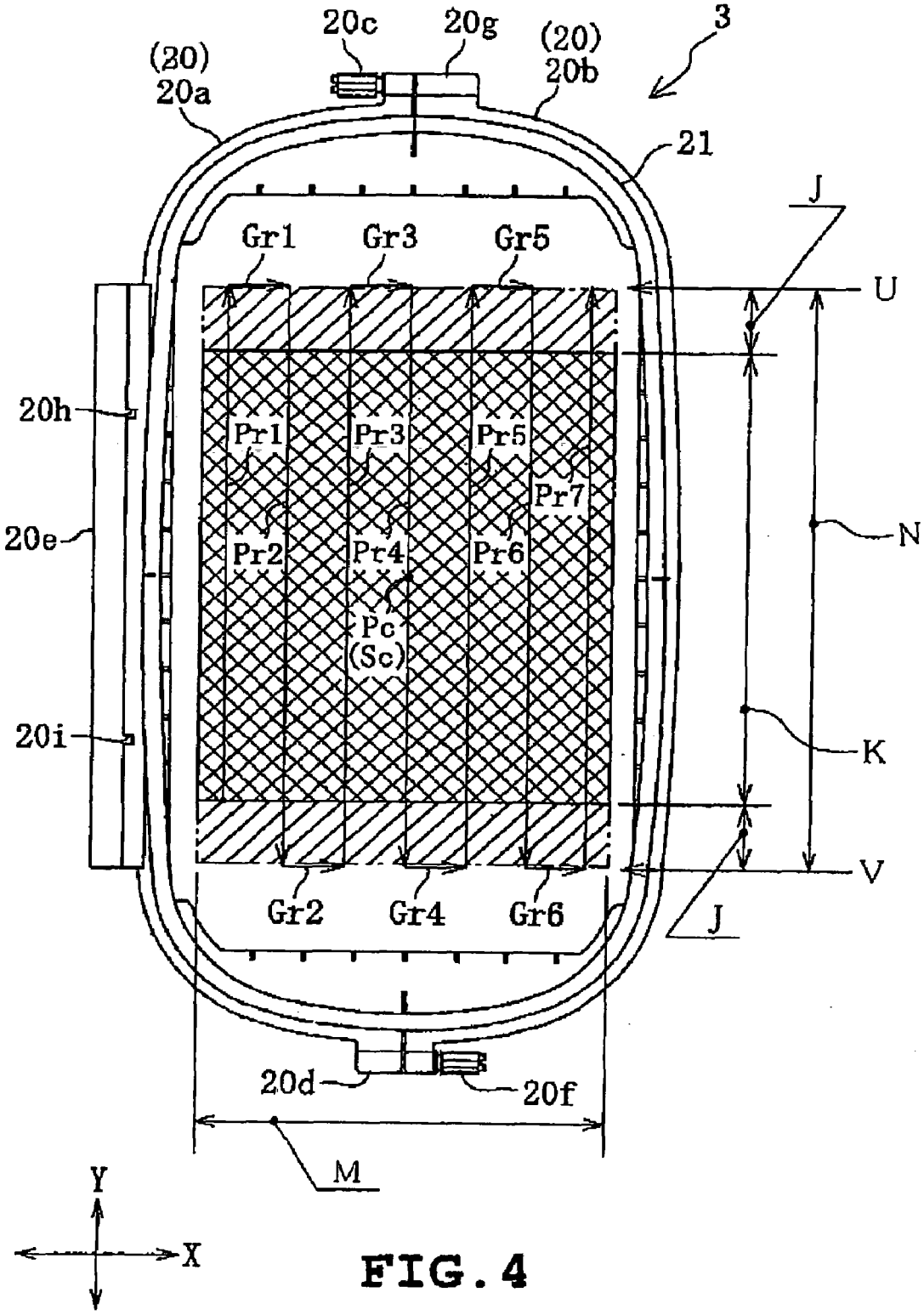
FIG. 4 is a plan view of a cloth holding frame.

Next, a description will be given on the cloth holding frame 3 holding the workpiece cloth on which embroidery is sewn. As shown in FIGS. 3 and 4, the cloth holding frame 3 is formed in substantially rectangular frame-form (substantially ellipse-form), and as shown in FIG. 4, the length in the Y-direction thereof is elongated as compared with the X-direction thereof. The cloth holding frame 3, as shown in FIG. 4, has an outer frame 20 comprising a left outer frame portion 20*a* and right outer frame portion 20*b* and an inner frame 21 fitted into the outer frame 20. Provided in the left side outer frame portion 20*a* are a fastening screw portion having fastening screw 20*c*, a screw receiving portion 20*d*, and a connecting portion 20*e* (connecting portion 20*c* will be described later) detachably connecting to the frame drive unit 4. Provided in the right outer frame portion 20*b* are a fastening screw portion having a fastening screw 20*f* and a screw receiving portion 20*g*. When the workpiece cloth W is held by the cloth holding frame 3, first, the fastening screws 20*c* and 20*f* for the left and right outer frame portions 20*a*, 20*b* are loosened. Then, the workpiece cloth W is placed and set over the entire outer frame 20. Thereafter, the inner frame 21 is pressed into the outer frame 20 from above so as to clamp the workpiece cloth W and the fastening screws 20*c* and 20*f* are fastened with the workpiece cloth W in stretched state.

The connecting portion 20*e* will be described hereinafter. As shown in FIG. 4, the connecting portion 20*e* is arranged parallel with the left outer frame portion 20*a* of the cloth holding frame 3 and also arranged in a predetermined length. The connecting portion 20*e* has first and second positioning recesses 20*h* and 20*i* formed respectively thereto. When the first positioning recess 20*h* is engaged with a positioning protrusion 41*a* of a link lever 41 of the frame drive unit 4 (each described in detail afterwards), an embroidery area base position Sc (refer to FIG. 4) of the cloth holding frame is arranged to match a sewing base position HPc (refer to FIG. 3) which is based on the position of the sewing needle 15 of the sewing machine body 2. Also, when the second positioning recess 20*u* is engaged with the positioning protrusion 41*a* of the link lever 41 (each described in detail afterwards), a printable area base position Pc (refer to FIG. 4) of the cloth holding frame 3 is arranged to match the printing base position PPc (refer to FIG. 7).

Next, a description will be given on the frame drive unit 4 that moves the cloth holding frame 3 independently in the X-direction and the Y-direction respectively.

Figure 5:
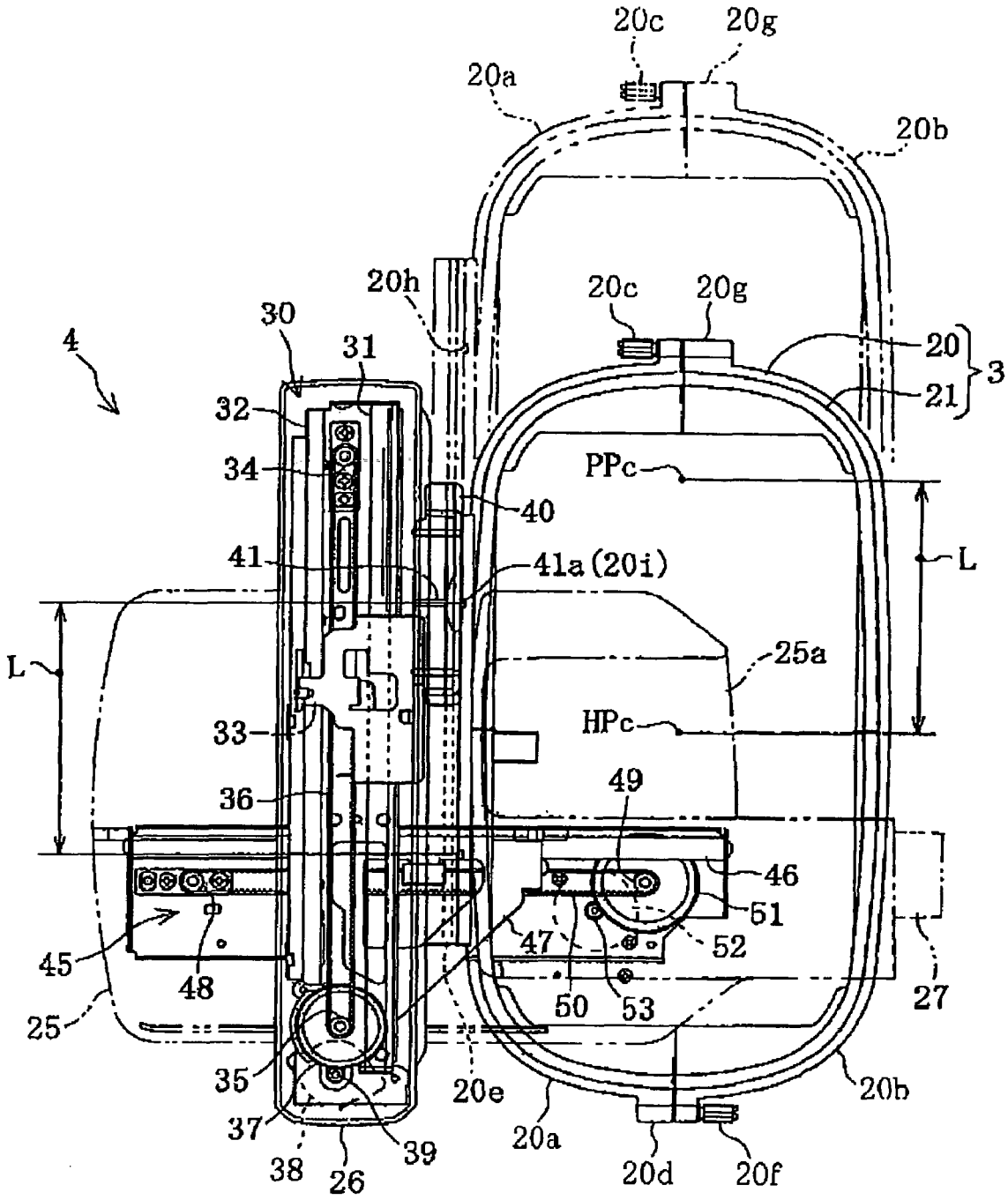
FIG. 5 is a plan view of an X-direction drive mechanism and a Y-direction drive mechanism with the cloth holding frame attached thereto.

Referring to FIGS. 5 and 3, the frame drive unit 4 has a main body case 25 taking on a rectangular-form in rear-view.

The main body case 25 is arranged to be detachably attached to the bed 10 (refer to FIG. 11) of the sewing machine body 2 via the attachment portion 25*a* provided integrally in the main body case 25. A movable case 26 elongated in the Y-direction (longitudinal direction) is provided on the main body case 25. The movable case 26 is adapted to be reciprocably drivable in the X-direction (lateral direction) with respect to the main body case 25 by the X-direction drive mechanism (first drive mechanism) 45. A Y-direction drive mechanism (second drive mechanism) 30 is provided inside the movable case 26.

First, the Y-direction drive mechanism 30, among the X-direction drive mechanism 45 and the Y-direction drive mechanism 30 will be described with reference to FIG. 5. In the Y-direction drive mechanism 30, a guide shaft 31 and a guide member 32 extending in the longitudinal direction (vertical direction in FIG. 5) are placed across the interior of the movable case 26. A movable carriage 33 movable along the guide shaft 31 and the guide member 32 is supported by the guide shaft 31 and the guide member 32. Pinion gears 34 and 35 are rotatably pivoted on both ends of the movable case 26, and an endless timing belt 36 is wound on both pinion gears 34 and 35. The carriage 33 is linked to the timing belt 36 at one location.

A large-diameter gear 37 is mounted coaxially on the pinion gear 35 in the near side (the lower side in FIG. 5). On the other hand, a drive gear 39 is mounted on a drive shaft of the Y-direction drive motor 38 comprising a stepping motor, and the gear 37 is placed in mesh engagement therewith. The timing belt 36 is moved by the drive of the pinion gear 35 driven by the Y-direction drive motor 38, thereby longitudinally moving the carriage 33 along the guide shaft 31 and the guide member 32.

The carriage 33 has a connecting member 40 having a predetermined length in the longitudinal direction (vertical direction in FIG. 5) fixed thereto. A connection lever 41 is provided at one location of the connecting member 40, and the connecting lever 41 has a positioning protrusion 41*a* formed in the distal end thereof that selectively engages with the first and the second positioning recesses 20*h* and 20*i* of the cloth holding frame 3. Thus, in case the cloth holding frame 3 is mounted on the connecting member 40 of the carriage 33 via the connecting portion 20*e* of the cloth holding frame 3, the cloth holding frame 3 is moved in the longitudinal direction, in other words, the Y-direction in synchronism with the movement of the carriage 33.

Next, a description will be given on the X-direction drive mechanism 45. In the X-direction drive mechanism 45, a guide shaft 46 extending in the lateral direction (lateral direction in FIG. 5) is disposed in the interior of the main body case 25. The guide shaft 46 has a movable body 47 movable along the guide shaft 46 supported thereto. The front end of the movable member 47 is connected to the lower side of the movable case 26 of the Y-direction drive mechanism 30. Pinion gears 48 and 49 are rotatably pivoted on both ends inside the main body case 25, and an endless timing belt 50 is wound on both pinion gears 48 and 49. The movable body 47 is connected to the timing belt at one location.

The pinion gear 49 in the right side (right side in FIG. 5) has a large-diameter gear 51 attached coaxially therewith. On the other hand, a drive shaft of the X-direction drive motor 52 comprising a stepping motor has a drive gear 53 mounted thereon, and the drive gears 53 and 51 are placed in mesh engagement. The timing belt 50 is moved by the drive of the pinion gear 49 rendered by the X-direction drive motor 52, thereby moving the movable member 47 laterally along the guide shaft 46. Thus, when the cloth holding frame 3 is mounted on the connecting member 40 of the carriage 33, the cloth holding frame 3 is moved in the lateral direction, in other words, the X-direction in synchronism with the movement of the movable body 47.

Figure 11:
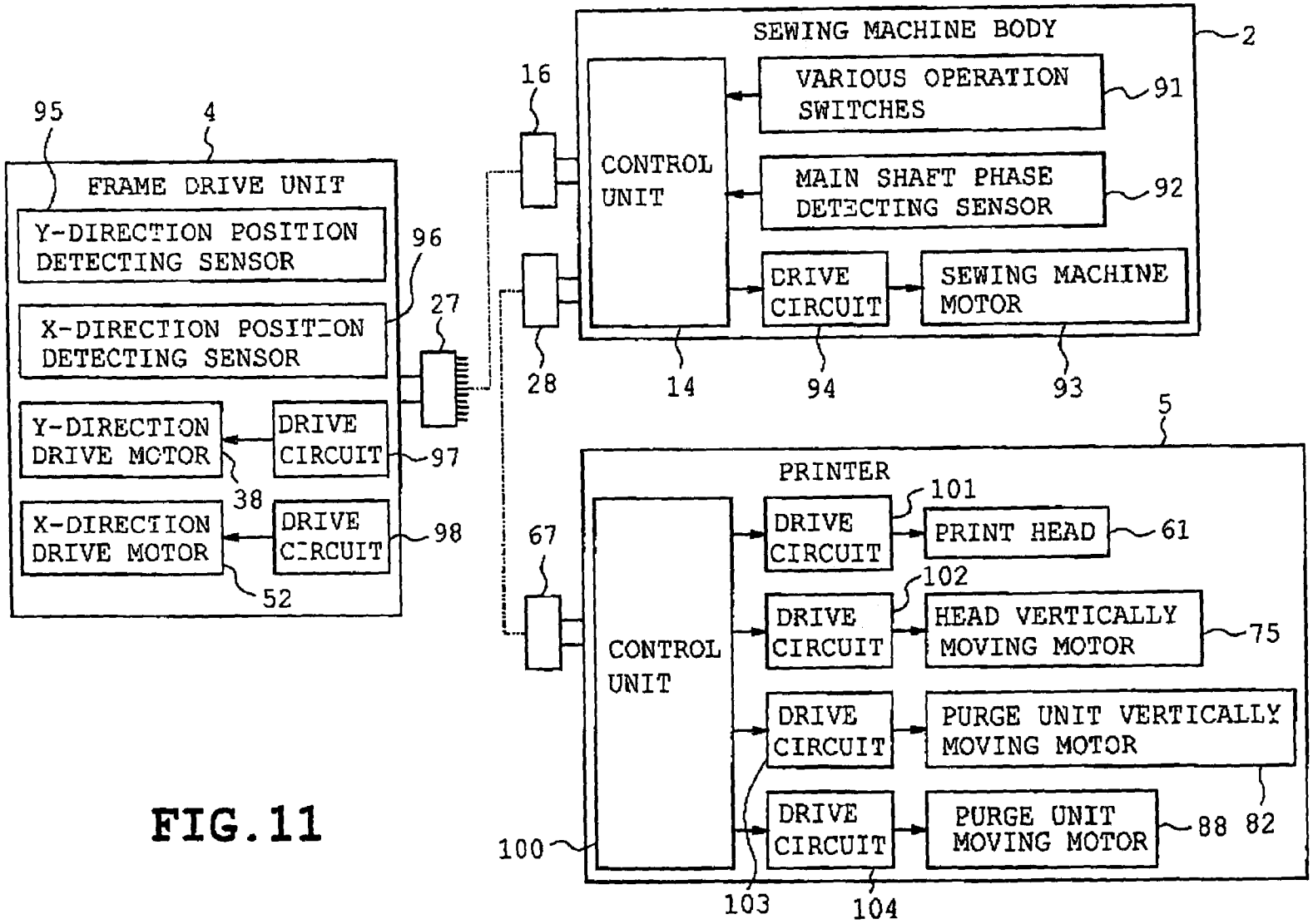
FIG. 11 is a block diagram or a control system of the embroidery sewing machine with printing function.

Referring to in FIG. 3, a male connector 27 (refer to FIGS. 1 and 11 also) is provided in the attachment portion 25*a* of the frame drive unit 4. On the other hand, a female connector 16 (refer to FIGS. 1 and 11) is provided in the sewing machine body 2. Thus, when the attachment portion 25*a* of the frame drive unit 4 is attached to the attachment subject of the sewing machine body 2, the male connector 27 of the attachment 25*a* and female connector 16 of the attachment subject establish an electrical connection. From this state, as shown in FIG. 11, the drive data for driving the drive motors 38 and 52 is transmitted from the control unit 90 to the frame drive unit 4. Furthermore, a detecting signal sent from position detecting sensors 95 and 96 of the frame drive unit 4 is transmitted to the control unit 90.

Next, a printer 5 for executing color printing operation with four colors of ink on the workpiece cloth W held by the cloth holding frame 3 is described with reference to FIGS. 2, 6, and 8 to 10.

Figure 9:
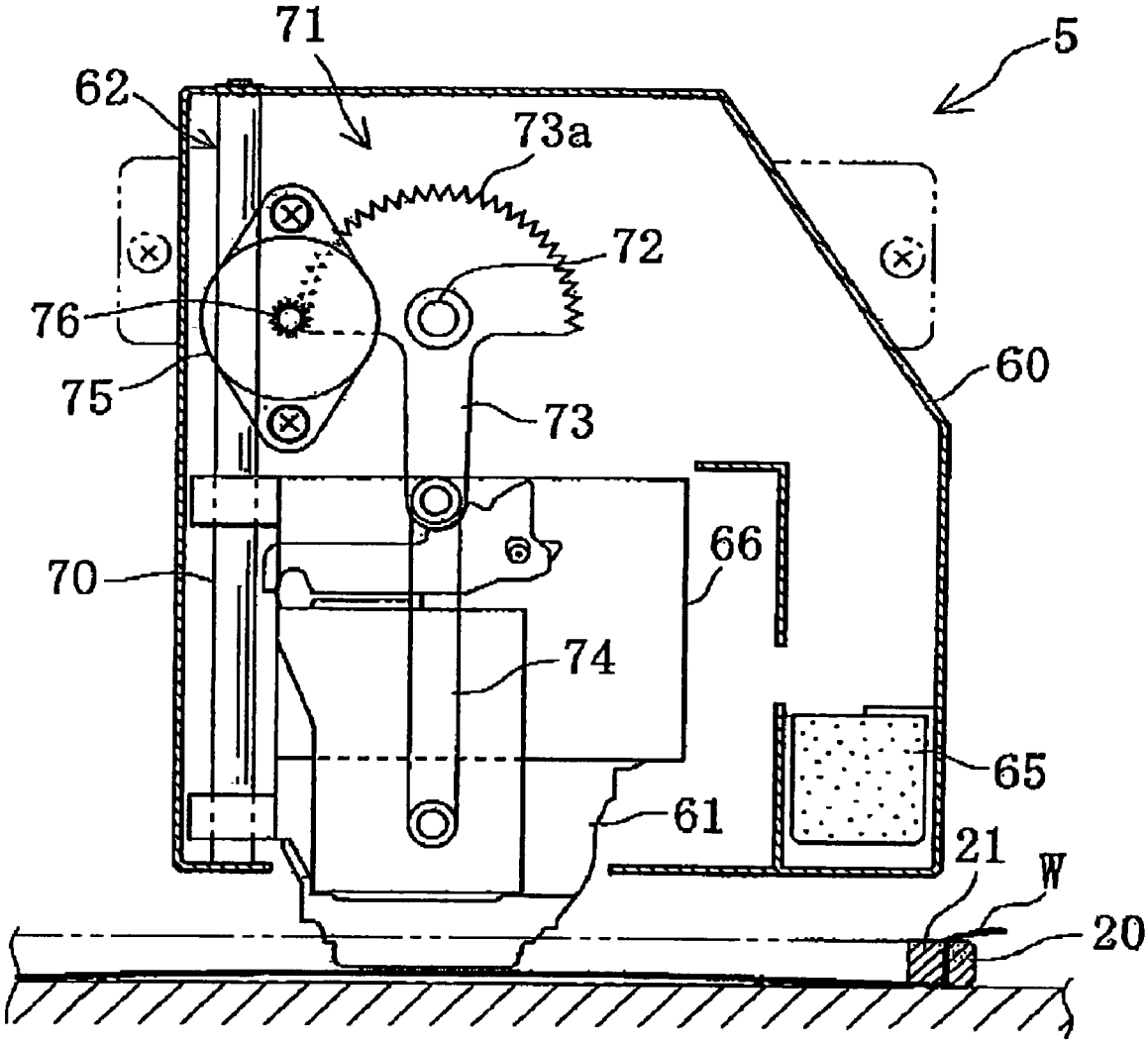
FIG. 9 corresponds to FIG. 8 with the print head in a printing position.
Figure 10:
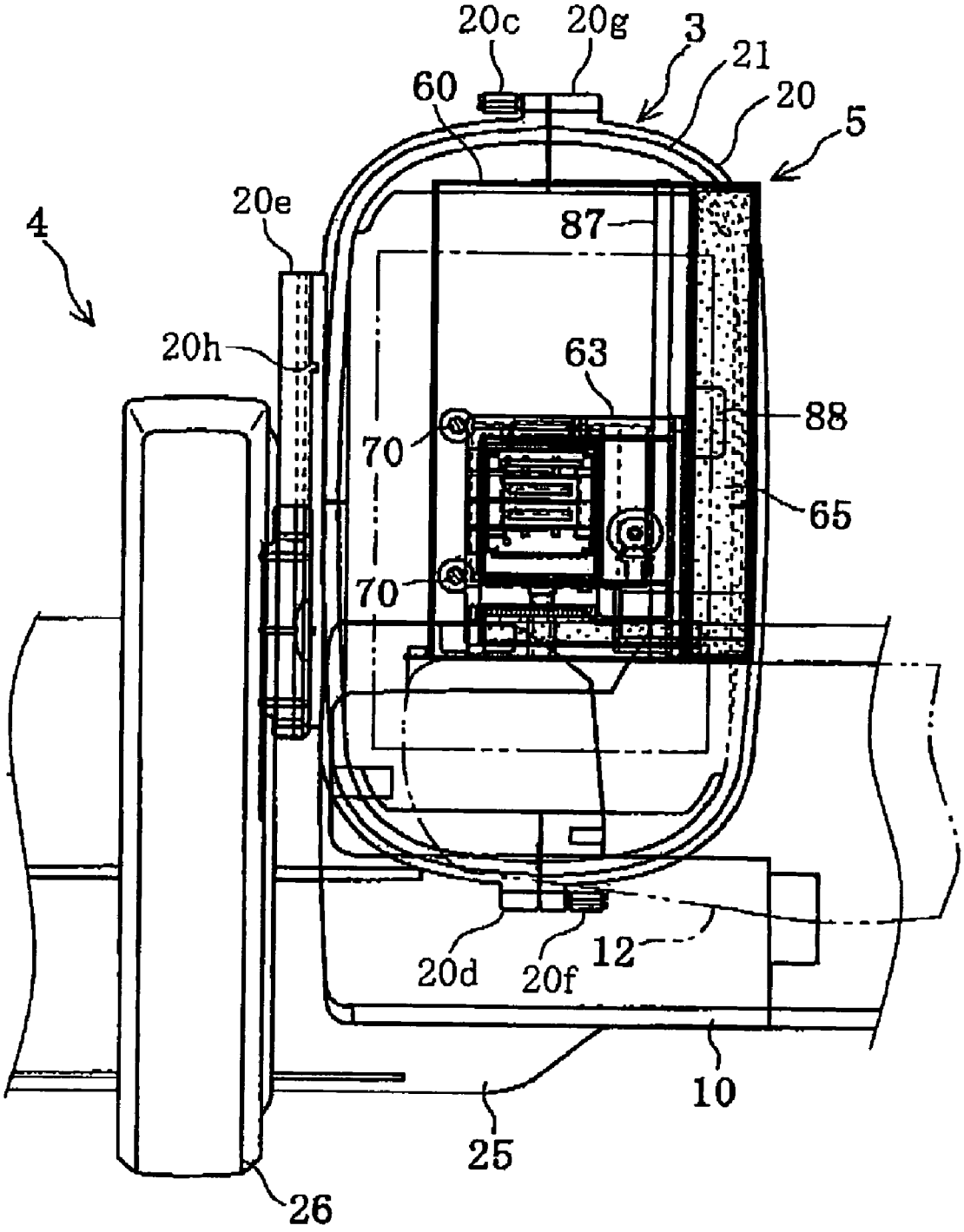
FIG. 10 is a transverse plan view of a main portion of a printer when the purge unit is in a purge position.

Referring to FIG. 2, the printer 5 is provided inside the printer case 60 fixed in the rear side (left side in FIG. 2) of the arm 12 of the sewing machine body 2. The printer 5, as shown in FIGS. 8 and 9, has a print head 61 oriented in the downward direction. The print head 61 is arranged to be positioned in the printing position (refer to FIG. 9) closely approaching the workpiece cloth W from above, and a retracted position (refer to FIG. 8) retracted upward from the printing position. Also, the printer 5 has a purge unit 63 (refer to FIGS. 6 and 8) and the purge unit 63 is moved longitudinally by a movement mechanism 64. Furthermore, the printer 5 is provided with an ink absorbing member 65 that absorbs waste ink. The printer 5 ejects four colors of ink from a plurality of ink-jet nozzles 61*b* (refer to FIG. 7 showing a lower surface view of ink-jet nozzle 61*b*) and so as to enable color printing of the workpiece cloth W held by the cloth holding frame 3.

A description will be given on the print head 61 hereinafter. Since the print head 61 is a well-known ink-jet color print head being generally used, the description therefor will be kept brief.

Figure 6:
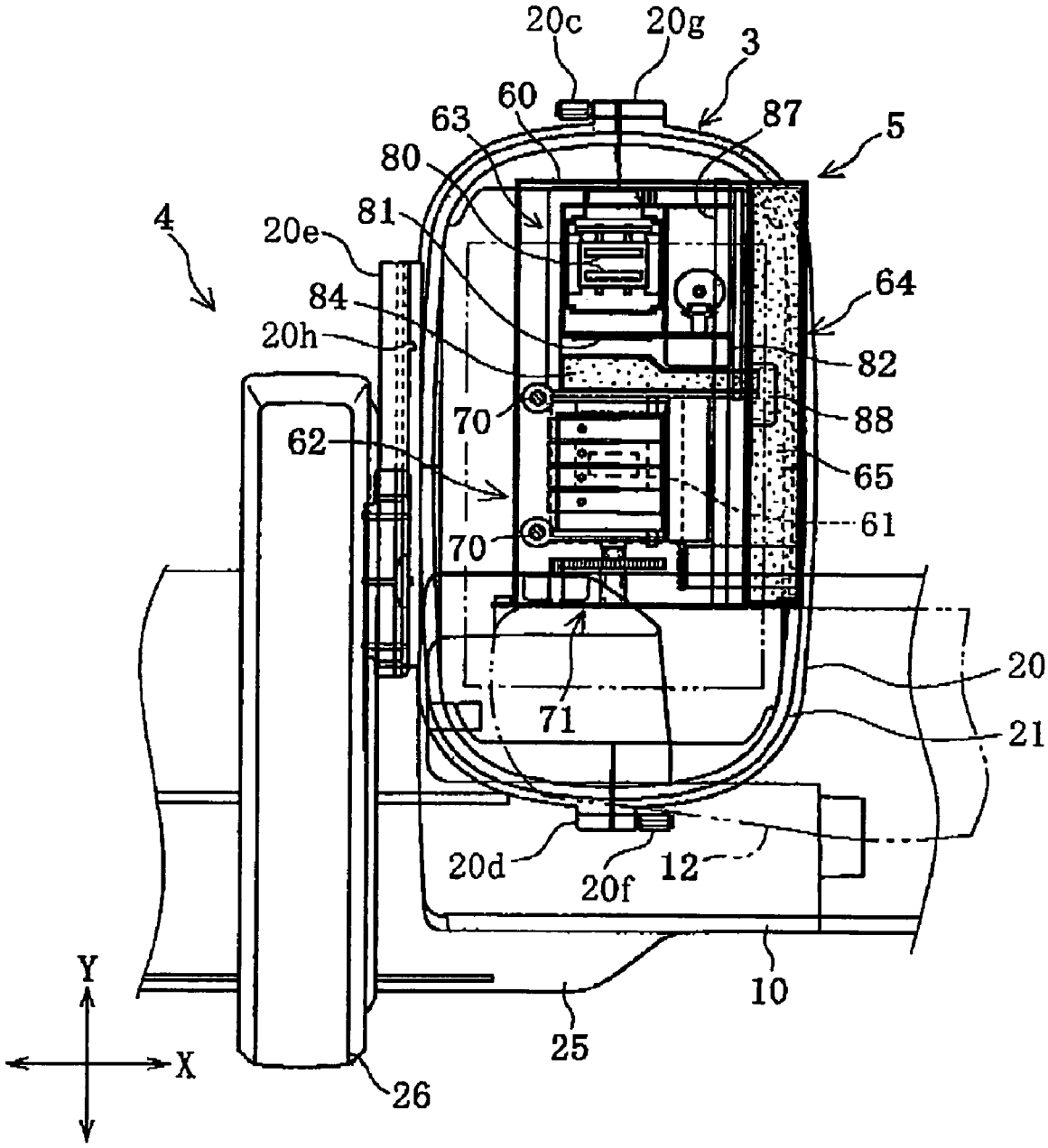
FIG. 6 is a transverse plan view of a main portion of a printer when a purge unit is in a retracted position.
Figure 7:
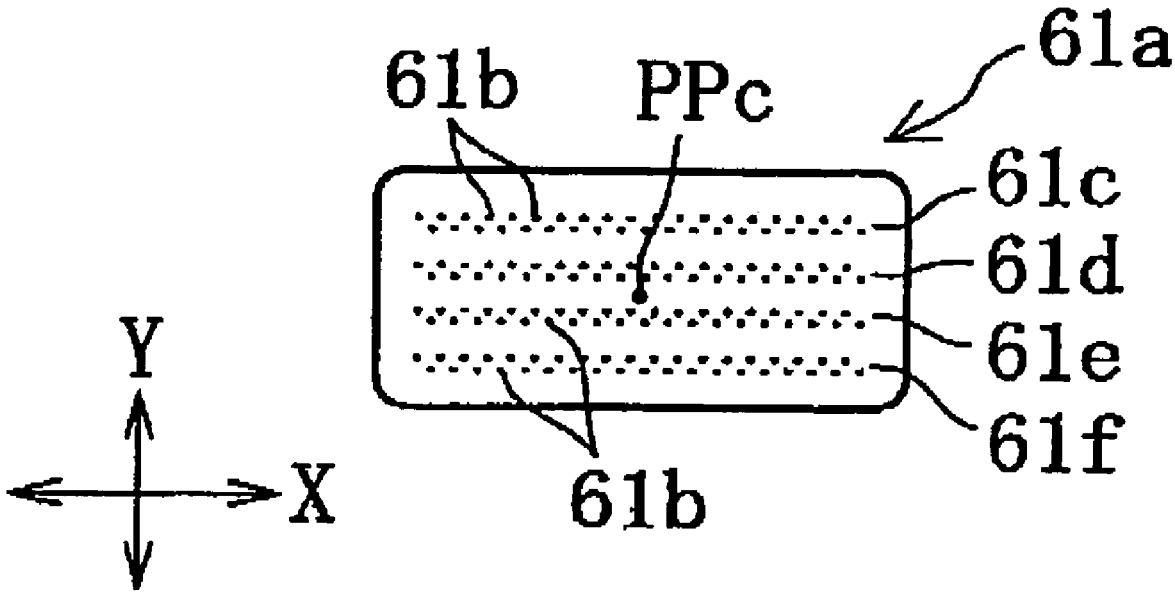
FIG. 7 is a bottom view of a head surface.

Referring to FIG. 6, the print head 61 is located in the substantial front portion (lower portion in FIG. 6) inside the printer case 60 and is arranged to be vertically movable. A head surface 61*a* of the print head 61, as shown in FIG. 7, has four nozzle arrays 61*c* to 61*f* aligned in the Y-direction (second direction), capable of ejecting four colors of ink, namely magenta (M), yellow (Y), cyan (C), and black (B) respectively. Though not shown in detail, each nozzle array 61*c* to

61*f* is constituted by aligning a predetermined number (75, for example) of ink-jet nozzles 61*b* in a zigzag profile parallel to the X-direction (first direction). Each ink-jet nozzle 61*b* is provided with a piezoelectric ceramic actuator (not shown). The piezoelectric ceramic actuator, as shown in FIG. 11, is arranged to bend in response to receiving a print drive signal sent from the control unit 100, thereby downwardly ejecting small amount of ink from the ink-jet nozzle 61*b* (each nozzle array 61*c* to 61*f*). The reference symbol PPc shown in FIG. 7 indicates the print base position of the print head 61.

Provided on the upper side of the print head 61, as shown in FIG. 8, is a cartridge case 66 accommodating four ink cartridges (not shown) containing magenta (M), yellow (Y), cyan (C) and black (B) ink. Thus, only the ink cartridge of the used up ink can be exchanged selectively. The print head 61 may employ a print head other than the piezoelectric ceramic actuator type.

As shown in FIG. 5, the sewing base position HPc for performing embroidery sewing with the sewing needle 15 and the print base position PPc for executing a printing operation with the print head 61 is displaced by distance L. However, in the present embodiment, the aforementioned first positioning recess 20*h* and the second positioning recess 20*i* is spaced by L. Thus, the sewing base position HPc can be associated with embroidery area base position Sc by the first positioning recess 20*h*, and the print base position PPc can be associated with printable area base position Pc by the second positioning recess 20*i*.

Referring to FIG. 6, a head position switching mechanism 62 is provided inside the printer case 60, more specifically in the front side (lower side in FIG. 6) of the print head 61. The head position switching mechanism 62, as shown in FIGS. 6, 8 and 9, has a front-and-rear pair of vertically oriented guide rod 70 that guides the print head 61 vertically movably between the printing position and the retracted position. Furthermore, the head position switching mechanism 62 has a head vertically moving mechanism 71 that switches the height of the print head 61 between the printing position in the lower side and the retracted position in the upper side.

The head vertically moving mechanism 71 as shown in FIGS. 8 and 9, has a crank member 73 pivotally mounted about a horizontal axis of the printer case 60 by a pivot pin 72. A sector gear 73*a* is formed on one end of the crank member 73. The sector gear 73*a* is in mesh engagement with a drive gear 76 mounted on a drive shaft of the head vertically moving motor 75. Also, the other end of the crank member 73 has a link member 74 linked therewith which is arranged to be rotatable with respect to the crank member 73 and the print head 61 respectively.

When the head vertically moving motor 75 is driven from the state shown in FIG. 8, the drive of the drive gear 76 is transmitted to the sector gear 73*a*, thereby moving the print head 61 to the printing position in the lower side as shown in FIG. 9. As opposed to this, when the head vertically moving motor 75 is driven from this state, the print head 61 is moved to the retracted position in the upper side.

As shown in FIG. 8, when the print head 61 is moved up to the retracted position, the later described purge unit 63 is moved forward to a purging position, and the print head 61 is purged (details described later) from the lower side. The purge unit 63 is in a box-form and a head cap 80 and a wiper 81 (refer to FIG. 6) are provided respectively on the upper end thereof. The purge unit 63 has a purge unit vertically moving motor 82, a suction pump 83, an ink receptacle 84, and the like, provided therein.

The head cap 80 is composed of a rubber made cap placed in intimate contact with the head surface 61*a* of the print head 61 from below. The head cap 80 is moved up by a purge unit vertically moving motor 67 when the print head 61 is moved up to the retracted position and the purge unit 63 is moved forward to the purging position (refer to U-position in FIG. 4), thereby to bring the outer periphery or the head cap 80 in intimate contact with the head surface 61*a* to cover the same from below. Thus, by enclosing (capping) the head surface 61*a* with the head cap 80, the plurality of ink-jet nozzles 61*b* can be prevented from drying and a purging operation can be executed therefor as described later, when printing is not executed. In such case, instead of moving up the head cap 80, the print head 61 may be lowered to the level of the head cap 80 by driving the head vertically moving motor 75 to bring the head cap 80 in intimate contact with the head surface 61*a*.

The aforementioned purging operation will be described briefly hereinafter. Purging operation is executed when the print head 61 is moved up to the retracted position and the purge unit 63 is moved forward to the purging position. At this time, when the purge unit vertically moving motor 82 is driven, as described earlier, the head cap 80 is moved up to enclose the head surface 61*a* of the print head 61. In this state, when the interior of the head cap 80 is situated in a negative pressure by the drive of the suction pump, small amount of ink, air bubbles and debris are sucked and removed from the ink-jet nozzle 61*b* of the print head 61. The wiper 81 is composed of a rubber made blade, and is placed slightly higher than the head surface 61*a* of the print head 61.

Next, a carrier mechanism 64 that carries the purge mechanism 63 in the longitudinal direction will be described hereinafter. As shown in FIG. 8, the carrier mechanism 64 includes two parallel guide rails 87 arranged one over the other extending in the longitudinal direction inside the printer case 60 (in the direction perpendicular to the FIG. 8 plane). A purge unit 63 is supported movably in the longitudinal direction by the guide rails 87. A purge unit carrier motor 88 is disposed in the right side of the guide rails 87 and a pinion gear 92 is mounted on the output shaft of the purge unit carrier motor 88. The pinion gear 92 is placed in mesh engagement with the rack gear 63*a* formed on the upper surface of the purge unit 63. When the purge unit carrier motor 88 is driven, the purge unit 63 is arranged to be carried between the retracted position (refer to FIG. 6) in the rear side and the purging position (refer to FIG. 10) in the front side.

After the purge unit 63 is carried to the purging position and the purging operation is performed on the print head 61, the purge unit 63 is carried to the retracted position in the rear side by the purge unit carrier motor 88. At this time, the head surface 61*a* of the print head 61 is wiped by the upper end of the wiper 81. Thus, the remaining ink in the head surface 61*a* is neatly cleaned.

Also, even when the workpiece cloth W is in the process of being printed by the print head 61, there are cases where the ink is ejected for only a predetermined time period. In such case, the ink-jet nozzle 61*b* is flushed (empty ejection of ink) in a predetermined flushing position (refer to FIG. 4) outside the printable area, thereby normalizing the ink-jet nozzle 61*b*. When the print head 61 (ink-jet nozzle 61*b*) is carried to the flushing position (refer to V position in FIG. 4), the ink receptacle 84 is disposed under the head surface 61*a*. Thus, the ink flushed from the ink-jet nozzle 61*b* is tentatively received by the ink receptacle 84 and thereafter drawn out to the ink absorbing member 65.

The ink absorbing member 65 is made of a material such as a felt, and is extended so as to fully occupy the length taken in the longitudinal direction (direction perpendicular to FIG. 8, 9 plane) as shown in FIGS. 8 and 9. Thus, the purged or flushed waste ink is absorbed and accumulated. A purge mechanism is constituted by the purge unit 63 provided with the head cap 89, the suction pump 33, and the purge unit vertically moving motor 82. Also, the cap mechanism is constituted by a purge unit 63 provided with the head cap 80 and the purge unit vertically moving motor 82.

Next, a control system of the embroidery sewing machine with printing function will be described based on FIG. 11. First a description will be given on the sewing machine main body 2. The sewing machine main body 2 has a control unit 90 having a CPU, ROM, RAM, and the like; various types of operation switches 91 such as embroidery pattern selection switches; a main shaft phase detection sensor 92 for detecting a rotational phase of the main shaft; a drive circuit 94 for driving the sewing machine motor 93; and the like provided therewith.

Also, provided in the frame drive device 4 is a Y-direction position detection sensor 95 that detects the Y-direction position of the carriage 33; an X-direction position detection sensor 96 that detects the X-direction position of the movable case 26; a drive circuit 97 that drives the Y-direction drive motor 38; a drive circuit 98 that drives the X-direction drive motor 52; and the like.

Provided in the printer 5 is a control unit 100 having a CPU, ROM and RAM; a drive circuit 101 that drives the print head 61; a drive circuit 102 that drives the head vertically moving motor 82; a drive circuit 104 that drives the purge unit moving motor 88; and the like.

When the frame drive device 4 is attached to the sewing machine main body 2, the male connector 27 provided in the attachment portion 25*a* of the frame drive device 4 and the female connector 16 provided in the attachment subject portion of the sewing machine main body 2 are connected electrically as described earlier. Then, the frame drive device 4 controls the movement of the carriage 33 based on various types of movement control signals transmitted from the control unit 90. Also, the connection between the printer 5, the sewing machine main body 2, and the control unit 90 is established by the female connector 28 provided on the sewing machine main body 2 and the male connector 67 provided on the printer 5. Thus, the printer 5 performs print control based on various print control signals transmitted by the control unit 90.

The printer 5 executes printing operation on the workpiece cloth W by ejecting ink from the print head 61 in synchronism with the reciprocating movement of the cloth holding frame 3 holding a workpiece cloth, which is moved in one way at a time in the Y-direction by the cloth drive unit 4; whereupon completion of printing one print line (one way), the embroidery frame 3 (workpiece cloth W) is fed by one print line in the X-direction and the process repeats itself thereafter.

Since the Y-direction drive mechanism 30 and the X-direction drive mechanism 45 of the frame drive device 4 employs a stepping motor as a drive source as described earlier, acceleration time taken from the stopped state of each drive motor 38 and 52 until reaching the predetermined rotational speed; and deceleration time taken from the predetermined rotational speed to the stopped state are required to prevent the stepping motor from falling out of step upon switching the rotational direction. However, in such case, each drive motor 38 and 52 are rendered in accelerating/decelerating state, exhibiting instability in speed, at the time of rotation start and rotation stop. Printing operation executed in the accelerating/decelerating state provides poor printing performance. Therefore, the workpiece cloth W is printed in an area (refer to area K in FIG. 4) exclusive of accelerating/decelerating area J (refer to J in FIG. 4) corresponding to the aforementioned accelerating/decelerating state.

At this time, as shown in FIG. 3, in driving the cloth holding frame 3 in the X-directional drive (the lateral direction in FIG. 3), the movable distance of the cloth holding frame 3 in the X-direction is limited by the presence of the foot 11. However, since no interference is experienced in driving cloth holding frame 3 in the Y-direction, (vertical direction in FIG. 3), the cloth holding frame 3 is provided with sufficient space for movement in the Y-direction. Thus, as shown in FIG. 4, reduction of X-directional area of the printable area K is prevented by arranging the printing direction of the printer 5 with respect to the workpiece cloth W in the Y-direction and providing accelerating/decelerating area J in both ends in the Y-direction respectively within the cloth holding frame (within the printable area). As shown in FIG. 4, there is no change in the Y-directional embroidable area N.

In the above case, though there is no reduction in the X-directional printable area M (in this case, inclusive of embroiderable area) of the printable area K, the Y-directional area is reduced by the accelerating/decelerating area J on both ends thereof. However, since the Y-directional movable distance of the Y-direction drive mechanism 30 and the Y-directional dimension of the cloth holding frame 3 are increased, there is no actual reduction of Y-directional printable area. Moreover, since the printing direction is taken in the Y-direction (longer direction) and the cloth feed direction is taken in the X-direction, in other words, the shorter direction, the Y-directional drive motor 38 experiences less times of drive direction switching, in which respect, the overall accelerating/decelerating area, in other words, the unprintable area in the embroiderable area can be reduced as compared with the printing direction taken in the X-direction.

As a result, the printable area K relative to the size of the cloth holding frame 3 can be maximized. In FIG. 4, reference symbol Sc indicates the center of the embroiderable area as well as the embroidery area base position, and the reference symbol Pc indicates the center of the printable area as well as the printable area base position.

Next, the operation and effect of an embroidery sewing machine 1 with printing function having the aforementioned construction will be described hereinafter.

In embroidering the workpiece cloth w while driving the frame drive device 4, first, a first positioning recess 20*h* of the cloth holding frame 3 holding the workpiece cloth W is engaged and connected with the positioning projection 41*a* of the frame drive device 4. At this time, as shown in FIGS. 4 and 5, the sewing base position HPc is associated with the embroidery area base position Sc. Thereafter, the frame drive device 4 is driven in synchronism with the vertical movement of the sewing needle 15 driven by the sewing machine motor 93, whereby the embroidery pattern is formed on the workpiece cloth W held by the cloth holding frame 3. The embroidery seam as shown in FIG. 4 is formed in the embroidable area (refer to N in FIG. 4) indicated by leftwardly descending line.

On the other hand, in printing the workpiece cloth W with the printer 5, first, a second locating recess 20*i* of the cloth holding frame 3 holding the workpiece cloth W is engaged and connected with the locating projection 41*a* of the frame drive device. At this time, as shown in FIGS. 4 and 5, the print base position PPc is associated with printable area base position Pc. Printing operation is executed in the printable area (refer to K in FIG. 4) indicated by leftwardly descending and rightwardly descending lines.

When executing a printing operation, first, as shown in FIG. 4, the cloth holding frame 3 is moved in the Y direction (downward direction in FIG. 4), and the print head 61 (refer to FIG. 6) is relatively moved in the Y-direction (upward direction in FIG. 4). Thus, the workpiece cloth W is printed along the first print scan Pr1 until the print head 61 reaches the acceleration/deceleration area (refer to J in FIG. 4). When the print head 61 reaches the acceleration/deceleration area, printing is stopped and the cloth holding frame 3 is decelerated and to a halt. Thereafter, the cloth holding frame 3 is moved by a small distance in the X-direction along the first cloth feed movement Gr1. Then the cloth holding frame 3 is accelerated and moved along a second print scan Pr2 and thereafter pursue a second cloth feed movement Gr2, a third print scan Pr3, and a third cloth feed movement Cr3, and finally execute a sixth cloth feed movement Gr6 and a seventh print scan Pr7 to finish the printing operation.

As described above, the embroidery sewing machine with printing function in accordance with the present embodiment provides acceleration/deceleration areas of the Y-direction drive motor 38 employing a stepping motor, respectively in both ends in the Y direction of the embroidable area (refer to N in FIG. 4), and is arranged to execute a printing operation exclusive of the acceleration/deceleration area, however is arranged to have an elongated Y-dimension for the printable area in view of the acceleration/deceleration area. Thus, there is no reduction in the Y-dimension of the printable area (X-dimension has no acceleration/deceleration area, hence is not reduced) and sufficient printable area can be secured with respect to the cloth holding frame 3.

Also, the print head 61 of the printer 4 has a plurality of nozzle arrays 61*c* to 61*f* capable of ejecting ink of plurality colors.

Also, the print head 61 of the printer 5 is arranged to have a cap mechanism used in the form of a head cap 80 to cover the head surface 61*a* of the print head 61. Therefore, air bubbles and debris inside the ink-jet nozzle 61 can be removed by purging the same by the purge mechanism, and the head cap 80 prevents the ink from drying when printing operation is not executed.

Also, the sewing machine body 2 and the printer 5 are provided integrally. Thus, there is no need to attach/detach the cloth holding device 3 to/from the sewing machine body 2, and both embroidery sewing and printing can be executed with the cloth holding frame 3 connected to the frame drive unit 4. In such case, since the workpiece cloth W is not removed from the cloth holding frame 3 at the time of embroidery sewing and printing, an embroidery seem can be printed with improved positioning precision.

Also, though the cloth holding frame 3 takes on an elongated shape in which the Y-direction is longer than the X-direction, the printer 5 is arranged to print the Y-dimension of the printable area in a non-stop reciprocating manner. Therefore, number of cloth feed times of feed the cloth in the X-direction after tentatively stopping the movement of the print head 61 in the Y-direction is reduced as compared with a printing operation executed in the X-direction, thereby reducing the duration of the overall printing process.

The present invention is not limited to the embodiment described above or shown in the drawings but can be modified or expanded as follows.

First, the printer 5 may be arranged to be detachable from the sewing machine body 2 and be attached thereto as required.

Also, the printer 5 may include, other than the control unit, printing data storage memory that stores printing data and embroidery data storage memory that stores embroidery data. In such case, it is preferable to arrange the printer 5 to be detachable from the frame drive unit 4 and print the workpiece cloth W while transmitting the embroidery data created in advance from the printer 5 to the frame drive unit 4.

Also, the printer 5 may be of a single-color use that prints in a single color such as black, cyan, or the like.

Also, the direction of movement, or the like, of the purge unit 63 may be arranged adjustable within the scope of the invention.

INDUSTRIAL APPLICABILITY

As described above, the embroidery sewing machine with printing function of the present invention is useful for a household embroidery sewing machine provided with printing function.

The invention claimed is:

1. An embroidery sewing machine with a printing function including a sewing machine body having a bed, a foot, an arm, and being capable of sewing a workpiece cloth by a sewing unit; a cloth holding frame holding the workpiece cloth to be sewn; a frame drive unit moving the cloth holding frame independently in two mutually perpendicular directions in a horizontal plane; an ink-jet printer having a print head printing the workpiece cloth held by the cloth holding frame, and a control unit that controls the frame drive unit and the printer to print the workpiece cloth, wherein:

the frame drive unit includes a first drive mechanism that moves the cloth holding frame in a first direction parallel with a lengthwise direction of the bed; and a second drive mechanism being driven by a stepping motor and that moves the cloth holding frame in a second direction perpendicular to the first direction;

the print head of the printer includes nozzle arrays with each nozzle array having a plurality of ink-jet nozzles aligned parallel to the first direction;

the printer prints the workpiece cloth while moving the cloth holding frame in the second direction by the second drive mechanism;

the cloth holding frame is arranged so that a length in the second direction is greater than a length in the first direction; and the control unit, when printing the workpiece cloth, controls the frame drive unit so that an acceleration/deceleration area of the second drive mechanism where a change in rotational speed of the stepping motor occurs is arranged at both ends of the second direction within the cloth holding frame, and controls the printer to execute printing operation exclusive of the acceleration/deceleration area.

2. The embroidery sewing machine with the printing function according to claim 1, wherein the print head further comprises a plurality of nozzle arrays aligned in the second direction.

3. The embroidery sewing machine with the printing function according to claim 1, wherein the printer includes a purging mechanism that purges the print head, and a cap mechanism that covers the print head with a cap.

4. The embroidery sewing machine with the printing function according to claim 1, wherein the sewing machine body and the printer are provided integrally.

* * * * *